US006378969B1

(12) United States Patent
Ferrari et al.

(10) Patent No.: US 6,378,969 B1
(45) Date of Patent: Apr. 30, 2002

(54) GUIDE FOR DRAWERS WITH BRAKED OPENING

(75) Inventors: Franco Ferrari, Località Deviscio, 2, 23900 Lecco; Carlo Migli, Lecco, both of (IT)

(73) Assignee: Franco Ferrari (IT)

( * ) Notice: Subject to any disclaimer, the term of this patent is extended or adjusted under 35 U.S.C. 154(b) by 0 days.

(21) Appl. No.: 09/481,870

(22) Filed: Jan. 12, 2000

(30) Foreign Application Priority Data

Jan. 27, 1999 (IT) ..... MI99A0144

(51) Int. Cl.[7] ..... A47B 88/14
(52) U.S. Cl. ..... 312/334.44; 312/334.12
(58) Field of Search ..... 312/330.9, 334.1, 312/334.7, 334.12, 334.16, 334.18, 334.44, 334.46; 384/19

(56) References Cited

U.S. PATENT DOCUMENTS 1,969,749 A * 8/1934 Harsh ..... 312/334.44 X
1,981,246 A * 11/1934 Pipe ..... 312/334.12 X
3,375,051 A * 3/1968 Anderson ..... 312/330.1 X
3,773,395 A 11/1973 Antonaccio
4,119,377 A 10/1978 Barber et al.
4,692,035 A * 9/1987 Rock et al. ..... 312/334.44 X
4,919,548 A 4/1990 Lautenschlager
5,490,724 A * 2/1996 Domenig ..... 312/334.44 X

FOREIGN PATENT DOCUMENTS

DE 3332517 9/1983
GB 1433424 7/1972

* cited by examiner

*Primary Examiner*—Peter M. Cuomo
*Assistant Examiner*—Michael J. Fisher
(74) *Attorney, Agent, or Firm*—Shlesinger, Fitzsimmons & Shlesinger

(57) ABSTRACT

A guide for drawers comprises two elongated metal parts, mutually slidable along each other. One of said two parts has a wall conveniently bent to define a raceway (15) with play for a wheel (13) rotatably fastened to the other part. In the raceway (15) a wall region (17) is deformed to define a passage (d) having a predetermined interference for the wheel. A method of manufacturing the guide comprises the steps of bending a wall of a first one of said two parts to define the raceway (15) with play for the wheel (13), inserting a gauged template (21) into a predetermined raceway region, deforming the raceway from the outside against the template to obtain the passage with a predetermined interference for the wheel in the predetermined region (17). Also described is a guide manufacturing machine.

8 Claims, 1 Drawing Sheet

GUIDE FOR DRAWERS WITH BRAKED OPENING

BACKGROUND OF THE INVENTION

The present invention relates to a guide for drawers with controlled sliding. The invention further relates to a method of manufacturing such a guide and a manufacturing machine applying such a method.

In the field of guides for drawers different applications are known in which a particularly clear locking of the drawer at the end of its stroke is required. An example of these applications is use of same in moving means such as ships or campers. Therefore guides have been proposed in which accessories acting like spring ratchets are applied to lock the wheel of the movable guide portion to its closed position.

This solution however is relatively expensive, since additional elements are required to be provided for the guides involving mere sliding. Furthermore, the additional elements may break or be damaged with use to such an extent that the guide may loose its desired locking quality in the closed position.

It is a general aim of the present invention to obviate the above mentioned drawbacks by providing a guide in which there is a region with controlled sliding without additional elements being required as compared with standard guides. Further aims are to provide a method and a machine for manufacturing such guides.

SUMMARY OF THE INVENTION

In view of the above aims, in accordance with the invention, a guide for drawers has been conceived which comprises two elongated metal parts, mutually slidable along each other, one of said parts having a wall of substantially stiff behaviour conveniently bent to define a raceway with play for a wheel rotatably fastened to the other part, characterised in that in the raceway a wall region is deformed to define a passage having a predetermined interference for the wheel.

Still in accordance with the invention a method of manufacturing a guide for drawers which comprises two elongated metal parts mutually slidable along each other has been devised, which comprises the steps of bending a wall of a first one of said two parts to define a raceway with play for a wheel rotatably fastened to the other part, inserting a gauged template into a predetermined region of the raceway, deforming the raceway from the outside against the template to obtain a passage with a predetermined interference for the wheel in said predetermined region.

Finally, a machine has been also devised for use in manufacturing guides for drawers formed of two elongated metal parts, mutually slidable along each other, one of said two parts having a wall of substantially stiff behaviour bent to define a raceway with play for a wheel rotatably fastened to the other part, the machine comprising retention elements for said one guide part, a gauged template to be inserted into the raceway in a predetermined region and press elements deforming the raceway from the outside against the template to obtain a passage having a predetermined interference for the wheel in said predetermined region.

BRIEF DESCRIPTION OF THE DRAWINGS

For better explaining the innovative principles of the present invention and the advantages it offers over the known art a possible embodiment applying these principles will be described hereinafter by way of example, with the aid of the accompanying drawings. In the drawings.

DETAILED DESCRIPTION OF THE INVENTION

Figure 1:
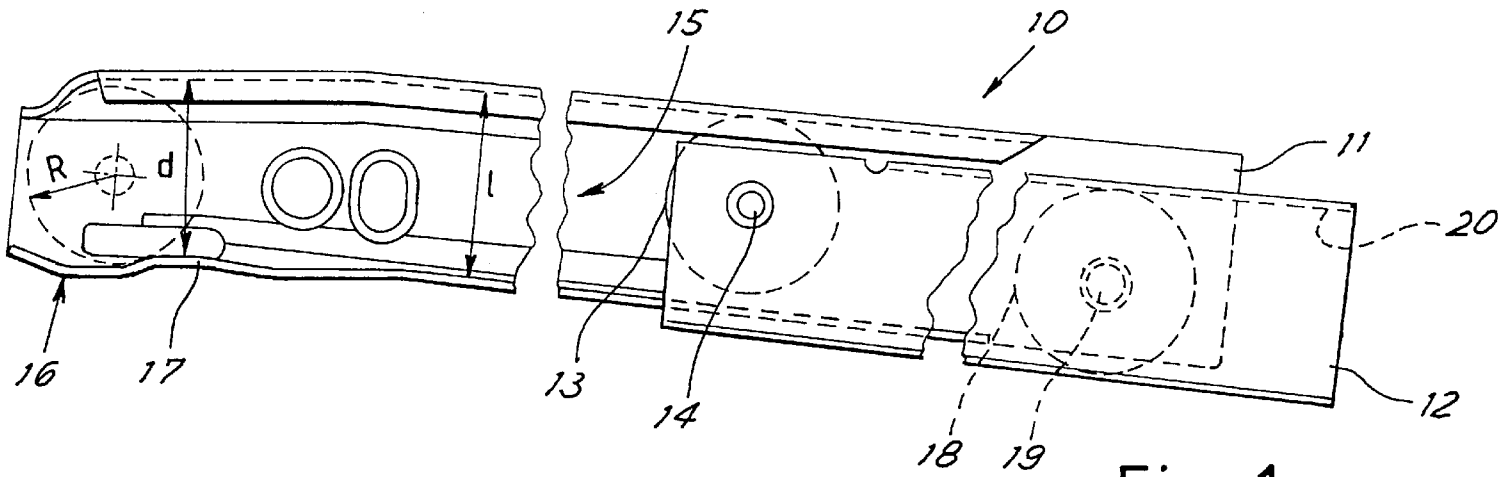
FIG. 1 is a fragmentary diagrammatic view of a guide in accordance with the invention.

With reference to the drawings, shown in FIG. 1 is a guide for drawers, generally identified by 10. Typically for each drawer a pair of guides 10 disposed on either side in mirror image relationship will be used. Guide 10 comprises two elongated metal parts 11, 12 mutually slidable along each other. The two parts are intended for being fastened to the drawer and a shoulder of the piece of furniture, respectively.

Part 11 has a wall of substantially stiff behaviour, and with spaced, marginal edge sections thereof to define therebetween a raceway 15 with play for a wheel 13 rotatably secured at 14 to an end of the other part 12. By "substantially stiff behaviour" it is intended that the wall is not yielding under the efforts to which it is usually submitted during sliding of the guide. In turn, part 11 can rotatably support, at one end thereof, wheel 18 rotatably mounted at 19 to constitute a slidable rest for a bracket-like bent wall section 10 of part 12.

Wheels are usually moulded from hard plastic material and therefore have relatively exact and constant sizes. Raceway 15 has a height "l" greater than 2R, where R is the wheel 13 radius. Wheel 13 can thus slide along the raceway bearing on the upper bent wall section of the raceway itself.

In raceway 15 there is a region 17 of the wall which is deformed to make the raceway narrower at a height "d" substantially close to 2R, so as to define a passage with a predetermined interference for wheel 13.

The passage with interference is disposed between an end section 16 of the raceway and the remaining section thereof. Section 16 corresponds to the position (shown by chain line) taken by wheel 13 when the guide is in the closed position, i.e., the position in which the two guide parts 11 and 12 are fitted one within the other and it generally corresponds to the closed drawer.

Advantageously, the deformed wall region 17 is in the lower raceway wall section and is shaped so that interference with wheel 13 gradually increases and decreases as the wheel passes region 17.

During sliding of the two guide parts 11 and 12 between the open and closed positions sliding takes place freely until close to the completely closed position, wheel 13 sliding in a raceway region of greater sizes than the diameter of the wheel itself. Close to the completely closed position the wheel must pass through section "d" embodying the passage with interference. Therefore a greater effort applied to the drawer will be required. Once the wheel 13 has gone beyond the narrow section, it is in its end position 16. Therefore, to reopen the drawer application of a force sufficient to cause passage of wheel 13 through the narrow section "d" will be required. The passage with interference is gauged in such a manner that passage of the wheel when a force under a preestablished threshold is applied to the drawer will be prevented. Such a passage is at all events conveniently gauged to avoid any excessive effort and undesired wear or deformation of the wheel.

For instance, the threshold limit must be of such a degree that it can be hardly reached or cannot be reached by merely tilting the piece of furniture to which the drawer belongs, so as to avoid opening of the drawer in case of furniture on boats, motor-vehicles, etc. that are submitted to rolling and pitching.

Gauging of the passage with interference must take place in a manner adapted to assure size "d" when the guide is finished. The following method has been found advantageous for manufacturing the guide. Starting from a cut sheet metal, bending of the wall takes place to define the raceway with play for the wheel which is rotatably fastened to the other part of the guide. The bent part is submitted to those operations that can have an impact on the final size of the raceway. Generally, these operations lead to have a raceway with size "l" having relatively high tolerances, even in the order of half a millimetre. If necessary, in the operations to be carried out also painting is included. When size "l" is stabilised, a gauged template (denoted by 21 in FIG. 2) is inserted into the predetermined region of the raceway and the raceway is deformed from the outside against the template to obtain the passage with a predetermined interference for the wheel in said predetermined region. Carrying out the gauging operation with the aid of the template after the other operations on the guide have been executed enables a high accuracy to be obtained (in the order of five hundreds of a millimetre, for example) in the size of passage "d", which size is therefore independent of the tolerance of size "l" of the remaining part of the raceway.

Figure 2:
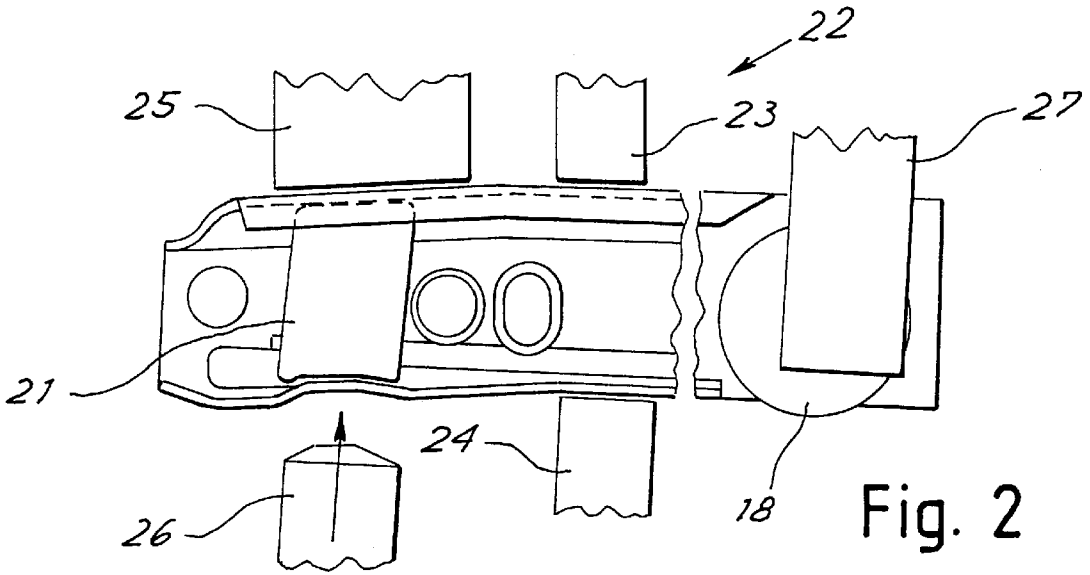
FIG. 2 is a fragmentary diagrammatic view of a manufacturing machine for the guide in FIG. 1.

Diagrammatically shown in FIG. 2 is a machine to be advantageously employed in manufacturing guides in accordance with the invention. This machine, generally identified by 22, comprises elements 23, 24 for retaining the guide part 11 in place, a gauged template 21 which is inserted into the raceway in the predetermined region, and press elements 25, 26 deforming the raceway against the template upon operation from the outside to obtain the gauged passage "d".

Advantageously, the machine 22 may comprise known means 27 (diagrammatically shown since it can be easily envisaged by a person skilled in the art) for mounting wheel 18 to element 11, so as to incorporate manufacture of the gauged passage into the normal mounting step, thereby obtaining the innovative guide of the invention without substantial additions in production time and cost.

At this point it is apparent that the intended aims have been achieved.

Obviously, the above description of an embodiment applying the innovative principles of the present invention is given by way of example only and cannot be therefore considered as a limitation of the scope of the invention as herein claimed. For instance, the exact shapes and proportions of the guide may vary depending on the particular requirements. The deformed wall region may be embodied in the upper part of the guide and may also comprise side cut-outs. Matrix 21 may be made expandable where necessary, so that it can be inserted into the guide.

What is claimed is:

1. A guide for drawers comprising two elongated metal parts, mutually slidable along each other, one of said parts having a wall of substantially stiff behaviour conveniently bent to define a raceway with play for a wheel rotatably fastened to the other parts characterised in that in the raceway a wall region is deformed to define a passage (d) having a predetermined interference for the wheel, and said interference gradually increases and then decreases as said wheel passes said deformed wall region.

2. A guide as claimed in claim 1, characterised in that the passage with interference (d) is disposed between a raceway section receiving the wheel when the guide is in the closed position and the remaining raceway section.

3. A guide as claimed in claim 1, characterised in that the deformed wall region is in the lower wall of the raceway.

4. A guide as claimed in claim 1, characterised in that said one part comprises a second slide wheel disposed thereon close to an end which is opposite to an end close to said deformed region.

5. A method of manufacturing the guide for drawers as defined in claim 1, comprising the steps of bending a wall of said one of said two parts to define said raceway with play for said wheel rotatably fastened to the other part, inserting a gauged template into a predetermined region of the raceway, deforming said wall region from the outside against the template to obtain said passage with said predetermined interference for the wheel in said predetermined region.

6. A method as claimed in claim 5, characterised in that before insertion of the template, painting of said first part is carried out.

7. A machine for use in manufacturing a guide as defined in claim 1 for drawers, said guide being formed of two elongated metal parts, mutually slidable along each other, one of said two parts having a wall of substantially stiff behaviour bent to define a raceway with play for a wheel rotatably fastened to the other part, the machine comprising retention elements for said one guide part, a gauged template insertable into the raceway in said wall region and press elements for operatively defining the raceway from the outside against said template to obtain said passage having said predetermined interference for the wheel in said deformed wall region.

8. A machine as claimed in claim 7, characterised in that it also comprises mounting means for a further wheel on said one part of the guide close to an end thereof which is opposite to the other end thereof that is close to said predetermined region.

* * * * *